US007998293B2

(12) United States Patent
Smith

(10) Patent No.: US 7,998,293 B2
(45) Date of Patent: Aug. 16, 2011

(54) SURFACE-MODIFIED MAGNESIUM POWDERS FOR USE IN PYROTECHNIC COMPOSITIONS

(76) Inventor: Paul Smith, Birmingham (GB)

( * ) Notice: Subject to any disclaimer, the term of this patent is extended or adjusted under 35 U.S.C. 154(b) by 410 days.

(21) Appl. No.: 12/167,845

(22) Filed: Jul. 3, 2008

(65) Prior Publication Data

US 2009/0025841 A1 Jan. 29, 2009

(51) Int. Cl.

| | |
|---|---|
| ***C06B 33/00*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/108.2; 149/37; 149/87; 149/109.4

(58) Field of Classification Search ..... 149/108.2, 149/37, 87, 109.4

See application file for complete search history.

(56) References Cited

U.S. PATENT DOCUMENTS

| | | | | |
|---|---|---|---|---|
| 2,261,221 | A * | 11/1941 | Bruner | 149/40 |
| 2,688,781 | A * | 9/1954 | Fahlberg et al. | 428/649 |
| 3,682,727 | A * | 8/1972 | Heinzelmann et al. | 149/19.2 |
| 6,174,391 | B1 | 1/2001 | Chen et al. | |
| 6,666,936 | B1 * | 12/2003 | Jorgensen et al. | 149/37 |

FOREIGN PATENT DOCUMENTS

| | | |
|---|---|---|
| CN | 1085259 A | 4/1994 |
| CN | 1772717 A | 5/2006 |
| GB | 947046 A | 1/1964 |
| GB | 0959836 A | 6/1964 |
| GB | 0963940 A | 7/1964 |

* cited by examiner

*Primary Examiner* — James E McDonough

(74) *Attorney, Agent, or Firm* — Kilpatrick Townsend & Stockton LLP; Gerald T. Gray

(57) ABSTRACT

Surface-modified metal fuels, which improve the stability in storage of pyrotechnics and methods for manufacturing such fuels, are provided. Improved storage stability is conferred either by alloying the precursor metal prior to the powder production process, or by forming an enhanced stability coating on the surface of the metal powders during the powder production process.

7 Claims, 1 Drawing Sheet

SURFACE-MODIFIED MAGNESIUM POWDERS FOR USE IN PYROTECHNIC COMPOSITIONS

CROSS-REFERENCES TO RELATED APPLICATIONS

This application claims priority to United Kingdom patent application No. 0713161.8, filed on Jul. 6, 2007 which is hereby incorporated by reference.

BACKGROUND

The present invention relates to surface modification of metal powder, such as that used as fuel in pyrotechnic compositions, in order to improve the stability of such compositions during storage and so reduce hydrogen out-gassing. It applies principally to magnesium (Mg) powder fuels as these are the least stable, but may also be applied to Aluminum (Al) powder fuel. The invention provides also a metal powder having an improved stability.

Metal-fuelled pyrotechnics are used to produce light, sound, luminosity or infra-red emissions. Magnesium is a preferred fuel due to its high reactivity, low boiling point and high heat of combustion.

The magnesium powder fuel may be made by twin-fluid atomization using compressed inert gas to atomize liquid magnesium to produce spherical particles; or by mechanical methods, such as rasping or milling solid ingot to produce irregular or flaked particles. The particle size range normally used is typically 75 microns or less and may have a surface area of about 3000 to 4000 $cm^2$ per $cm^3$.

The magnesium oxide coating, which is present on the particle surfaces, is porous and non-protective. The very desirable high reactivity of magnesium powder is to a great degree due to the high surface area of the particles and the non-protective nature of the oxide coating. However, the high reactivity of magnesium powder makes the pyrotechnic compositions containing it very vulnerable to degradation by moisture introduced during and after manufacture. The result is that highly flammable hydrogen gas may be released during the storage period before deployment, typically by the following reaction:

$$Mg+2H_2O \Rightarrow Mg(OH)_2+H_2$$

This out-gassing can cause swelling and de-lamination of the compacted pyrotechnic composition and in extreme cases can damage the hermetic sealing arrangements, allowing more moisture ingress and further shortening the useful storage life of the pyrotechnic. Most importantly, the presence of hydrogen gas in the vicinity of the pyrotechnics is very dangerous as it can very easily ignite and cause premature ignition of the pyrotechnics and possible injury to personnel in the vicinity Known methods for reducing out-gassing in pyrotechnics usually involve the application of organic coatings to the metal powder fuel. A typical example is disclosed in U.S. Pat. No. 6,174,391, which comprises coating magnesium powder with at least one ethylene and vinyl acetate co-polymer. This, and similar organic coating methods, aim to form a physical moisture barrier on the magnesium particles and thus reduce the hydrogen out-gassing reaction by preventing contact between the coated magnesium powder and any moisture present. Such methods have the disadvantage that at least one additional manufacturing step is introduced, which increases cost and complexity; particularly as the additional steps usually use liquid solvents which need to be subsequently removed. Also, the effectiveness of organic coatings reduces with time as moisture gradually penetrates the coating and exposes the underlying active magnesium substrate to attack.

BRIEF SUMMARY

The present invention provides a stable metal powder fuel for pyrotechnics and which has a reduced tendency to cause hydrogen out-gassing during storage of the pyrotechnic material.

The present invention also provides a metal powder, such as a magnesium or aluminum powder, wherein the powder particles are significantly more stable with respect to reaction with moisture than the surface of magnesium (or aluminum) powders currently used as fuel in pyrotechnics. This is achieved, in certain aspects, by modifying the composition of the oxide/hydroxide layer and/or the substrate, during the powder production process itself.

This novel approach improves on the prior art by removing subsequent powder processing steps and introducing surface modifications which are very effective in reducing the moisture reaction rate.

According to one embodiment, a method is provided for providing a metal powder fuel for pyrotechnics wherein the powder is provided with a reduced tendency to cause hydrogen out-gassing during storage of the pyrotechnic material by including in the process for forming the powder a process step which modifies the composition of the oxide/hydroxide layer and/or that of the substrate.

According to another embodiment, a magnesium alloy powder is provided for use as a fuel in pyrotechnic compositions and comprising, by weight, between about 2% and about 30% aluminum. In certain aspects, the magnesium alloy powder comprises by weight between about 0.1% and about 5% of manganese. In certain aspects, the magnesium alloy powder comprises by weight between about 5% and about 15% aluminum, between about 0.1% and about 5% manganese and between about 0.2% and about 2% zinc. In certain aspects, the magnesium alloy powder comprises by weight at least 50% magnesium.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

DETAILED DESCRIPTION

Figure 1:
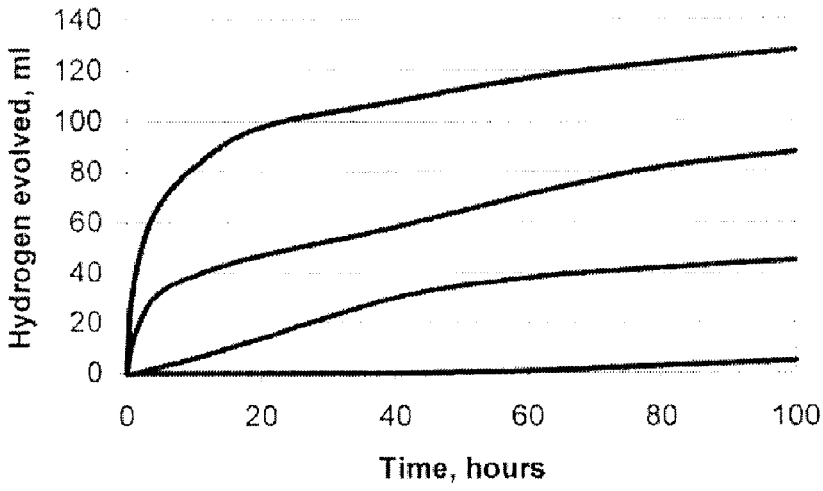
FIG. 1 of the drawings graphically illustrates volumetric hydrogen evolution rate with time during the accelerated moisture reaction test for alloyed powders FIG. 2 of the drawings graphically illustrates volumetric hydrogen evolution rate with time during the accelerated moisture reaction test for an in-situ conversion coated Mg powder.

The present invention provides a stable metal powder fuel for pyrotechnics and which has a reduced tendency to cause hydrogen out-gassing during storage of the pyrotechnic material.

The present invention also provides a metal powder, such as a magnesium or aluminum powder, wherein the powder particles are significantly more stable with respect to reaction with moisture than the surface of magnesium (or aluminum) powders currently used as fuel in pyrotechnics. This is achieved, in certain aspects, by modifying the composition of the oxide/hydroxide layer and/or the substrate, during the powder production process itself.

This novel approach improves on the prior art by removing subsequent powder processing steps and introducing surface modifications which are very effective in reducing the moisture reaction rate.

Techniques for doing this according to various embodiments include:

1) By adding surface stabilizing metallic elements to the magnesium in the liquid state as the feedstock ingots are being made; a process commonly called alloying. The alloyed ingots are then made into powder by mechanical means, such as milling. Alternatively, instead of forming ingots, the aluminum in the liquid state comprising the surface stabilizing elements maybe made into a powder by atomization. Yet a further alternative method is the production and storage of feedstock ingots which when required may be melted into a liquid state and made into a powder by atomization. The oxide/hydroxide layer formed on the alloyed powder surfaces and the substrate below this layer are modified by the added elements to make one or both more stable with respect to moisture reaction. It will be appreciated that this is a very efficient process as the enhanced stability of the powder produced is obtained without additional powder processing.

In this application, alloying has a major advantage in that the beneficial elements are distributed throughout the body of the particles as well as at the surface and can therefore confer resistance to moisture even if the coating is damaged by mechanical or chemical means. This improves long-term moisture resistance. This is fundamentally different to organic protective coatings, which when penetrated, allow reaction to proceed at the same rate as the unprotected surface. Surface stabilizing metallic elements which confer moisture resistance to magnesium powder include aluminum, manganese, beryllium, zirconium and rare earth metals such as yittrium and neodymium.

2) By forming non-oxide moisture-resistant coatings on the magnesium powder surface by chemical reaction. Coatings formed in this way are commonly called chemical conversion coatings. In the prior art, chromate chemical conversion coatings have been applied to both Mg and Al powders as a means of reducing reaction with moisture. However, chromate coatings methods are water-based, involving expensive wet mixing and drying of the coated powder.

Embodiments of the present invention overcome these disadvantages by performing the chemical conversion reaction under advantageous reaction conditions during the powder production process and is applicable to powders produced by atomization only. Advantage is taken of the unique set of conditions which occur during the atomization process, where molten Mg or Al droplets are in intimate contact with inert atomizing gas, for example Argon or Helium, for a very short time before solidification and cooling occurs. A small amount of a different gas, for example a halogenated hydrocarbon, is introduced into the atomizing gas prior to atomization. The gas mixture so formed is inert and stable under the normal atomizing conditions of temperature and pressure, but decomposes when in immediate contact with the molten Mg or Al droplets to form a moisture-resistant coating containing halides on the surface of the metal droplets before they solidify and cool. The halogenated gas must be continuously replenished as it is gradually depleted by this process, in order to maintain a substantially constant gas mixture composition. It will be appreciated by experts in the art that molten Mg or Al droplets can react explosively with halides under high concentration conditions. The gas mixture composition used in the invention must therefore be maintained between safe limits during the atomizing process.

Embodiments are particularly applicable to powders having a size in the order of the aforementioned particle size of up to 75 microns and a surface area of about 3,000 to 4,000 $cm^2$ per $cm^3$, but may be employed also with larger particle sizes, of, for example 150 microns having surface areas of 3,000 to 4,000 $cm^2$ per $cm^3$, or even larger sizes up to 500 microns having surface areas of about 500 to 700 $cm^2$per $cm^3$, or more.

Three examples of improved oxide/hydroxide coatings by alloying according to the invention and one example of in-situ conversion coating are given below by way of illustration.

Accelerated Moisture Reaction Test:

The rate of hydrogen evolution resulting from reaction between moisture and metal powders in pyrotechnic compositions is relatively slow and may take place over the several months or even years that the pyrotechnic is in storage. In order to rank the effectiveness of the surface-modified powders of the invention against the standard uncoated Mg powder, an accelerated test was required. This was achieved by exposing the test samples to moisture in the presence of salts known to accelerate the reaction. The salts used were in the form of a proprietary magnesium melting flux called Magrex 60, manufactured by Foseco in the UK. The Magrex 60 flux was dissolved in water to form a solution of IM concentration.

15 g of pure dry alumina was placed in a 200 ml glass reaction vessel with 1 ml of the flux solution. The mixture was stirred to homogenise. A 1 g sample of the Mg powder under test was added and quickly mixed in before fitting the vessel stopper and hydrogen collection tube. The hydrogen evolved was measured by collection over water. Temperature was controlled at 20±1 degrees Celsius by water bath.

FIG. 1 of the drawings graphically illustrates volumetric hydrogen evolution rate with time during the accelerated moisture reaction test for alloyed powders.

Curve A Standard unmodified Mg powder currently used for pyrotechnic fuel.

Curve B Mg+0.3% Mn alloyed powder according to the invention.

Curve C Mg+8% Al alloyed powder according to the invention.

Curve D Mg+8% Al+0.6% Zn+0.3% Mn alloyed powder according to the invention (e.g. AZ91E).

Figure 2:
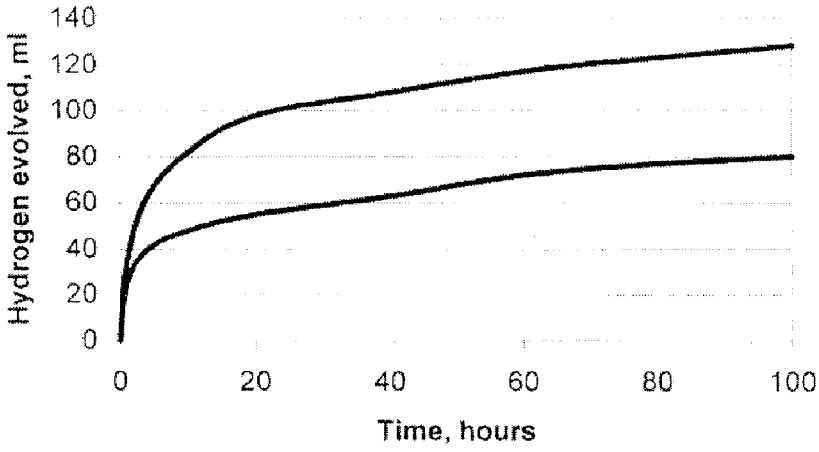

FIG. 2 of the drawings graphically illustrates volumetric hydrogen evolution rate with time during the accelerated moisture reaction test for an in-situ conversion coated Mg powder.

Curve E Standard unmodified Mg powder currently used for pyrotechnic fuel.

Curve F Mg powder with halide conversion coating produced in-situ from sulphur hexafluoride ($SF_6$) addition to the atomizing gas.

Examples 1-3

The following alloys were manufactured by standard ingot metallurgy. All alloy compositions are expressed in weight percent:

1. Mg+0.3% Mn
2. Mg+8% Al
3. Mg+8% Al+0.6% Zn+0.3% Mn

Each alloy was melted and atomized in exactly the same way as the standard magnesium powder currently manufactured and supplied as fuel for pyrotechnic applications. To ensure valid test comparisons, great care was taken to ensure that the particle size distribution and specific surface area were within the relevant specifications applying to the standard magnesium powder. The powder was subjected to the accelerated moisture reaction test and the results are given in FIG. 1.

Curve A gives the rate of hydrogen evolution over time for the standard Mg powder.

Curve B gives the rate of hydrogen evolution over time for the Mg+0.3% Mn alloy powder.

Curve C gives the rate of hydrogen evolution over time for the Mg+8% Al alloy powder.

Curve D gives the rate of hydrogen evolution over time for the Mg+8% Al+0.6% Zn+0.3% Mn alloy powder.

It will be seen that in comparison with the standard Mg powder, the Mg+8% Al powder of the invention shows significantly reduced hydrogen evolution rate, being about 3 times lower after 100 hours; the Mg+0.3% Mn alloy of the invention also shows a reduced hydrogen evolution rate, but not as marked; the Mg+8% Al+0.6% Zn+0.3% Mn alloy of the invention shows the lowest rate of hydrogen evolution, being about 24 times lower than the Mg standard powder after 100 hours.

Example 4

Commercially pure (99.8%) Mg ingots were atomized as above, but with an addition of 1.0 volume % $SF_6$ to the atomizing gas. The $SF_6$ reacted with the molten Mg droplets during atomization, forming a halide-containing surface layer on the Mg powder produced. The powder was subjected to the accelerated moisture reaction test as above and the result is given in FIG. 2, together with the result for the standard Mg powder. It will be seen that the halide-containing coating on the powder of the invention has significantly reduced the rate of hydrogen evolution in comparison with the standard Mg powder. It will be appreciated that the same effect can be obtained from other halide-containing gases, for example, hydro fluorocarbons, hydrofluorethers and fluoroketones and that this invention applies also to Al powder fuels in pyrotechnic compositions.

The invention provides also a metal powder fuel for pyrotechnics which may comprise substantially only metal powder in accordance with the present invention, or produced by a method of the present inventions, or a blend of said powder with a standard, prior known type of powder.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A magnesium alloy powder to use as a fuel in pyrotechnic compositions comprising by weight between 5% and 15% aluminum, between 0.1% and 5% manganese and between 0.2% and 2% zinc.

2. A magnesium alloy powder according to claim 1 and comprising by weight at least 50% magnesium.

3. A magnesium alloy powder according to claim 1 and comprising by weight at least 70% magnesium.

4. A magnesium alloy powder according to claim 1 and comprising by weight 8% aluminum, 0.3% manganese and 0.6% zinc.

5. A magnesium alloy powder according to claim 1 having particles with a particle size of up to 150 microns, the particles having surface areas of about 3000 to 4000 $cm^2$ per $cm^3$.

6. A magnesium alloy powder according to claim 1 having particles with a particle size of up to 75 microns, the particles having surface areas of about 3000 to 4000 $cm^2$ per $cm^3$.

7. A magnesium alloy powder according to claim 1 having particles with a particle size of up to 500 microns, the particles having surface areas of about 500 to 700 $cm^2$ per $cm^3$ or more.

* * * * *